US007117704B2

(12) United States Patent
Ogura et al.

(10) Patent No.: US 7,117,704 B2
(45) Date of Patent: Oct. 10, 2006

(54) IMPACT EXTRUSION MOLDED ARTICLE, AND IMPACT EXTRUSION MOLDING METHOD, AND AN IMPACT EXTRUSION MOLDING APPARATUS

(75) Inventors: Ken-ichi Ogura, Tokyo (JP); Seizo Ueno, Tokyo (JP); Toshiyuki Hosokawa, Tokyo (JP); Yoshiya Eda, Tokyo (JP)

(73) Assignee: Furukawa-Sky Aluminum Corp., Tokyo (JP)

( * ) Notice: Subject to any disclaimer, the term of this patent is extended or adjusted under 35 U.S.C. 154(b) by 0 days.

(21) Appl. No.: 10/915,459

(22) Filed: Aug. 11, 2004

(65) Prior Publication Data

US 2005/0005665 A1 Jan. 13, 2005

Related U.S. Application Data

(63) Continuation of application No. PCT/JP03/01447, filed on Feb. 12, 2003.

(30) Foreign Application Priority Data

Feb. 15, 2002 (JP) ..... 2002-038877

(51) Int. Cl.
*B21C 23/20* (2006.01)
*B21C 35/04* (2006.01)

(52) U.S. Cl. ..... 72/255; 72/267

(58) Field of Classification Search ..... 72/267, 72/355.2, 358, 255
See application file for complete search history.

(56) References Cited

U.S. PATENT DOCUMENTS

| | | | | |
|---|---|---|---|---|
| 2,162,776 | A * | 6/1939 | Friden | 72/256 |
| 2,909,281 | A * | 10/1959 | Koskinen | 72/377 |
| 2,913,107 | A * | 11/1959 | Biginelli | 72/267 |
| 3,037,623 | A * | 6/1962 | Rozenkranz | 72/255 |
| 3,394,578 | A * | 7/1968 | Biginelli | 72/254 |

FOREIGN PATENT DOCUMENTS

| | | |
|---|---|---|
| JP | 55-156632 | 12/1980 |
| JP | 57-64412 | 4/1982 |
| JP | 5-277620 | 10/1993 |

* cited by examiner

*Primary Examiner*—Lowell A. Larson
(74) *Attorney, Agent, or Firm*—Westerman, Hattori, Daniels & Adrian, LLP.

(57) ABSTRACT

An impact extrusion molded article that is molded while the metal-flow from a bottom of a slug set in a dice toward the side of the molded product article is suppressed; an impact extrusion molding method for manufacturing the impact extrusion molded article, and an impact extrusion molding apparatus used for the impact extrusion molding method, are provided.

4 Claims, 10 Drawing Sheets
(2 of 10 Drawing Sheet(s) Filed in Color)

IMPACT EXTRUSION MOLDED ARTICLE, AND IMPACT EXTRUSION MOLDING METHOD, AND AN IMPACT EXTRUSION MOLDING APPARATUS

This application is a continuation of international application PCT/JP2003/001447 filed on Feb. 12, 2003.

TECHNICAL FIELD

The present invention relates to an impact extrusion molded article, for example, a cover of small-sized equipment such as a portable game machine, a cellular phone, and the like that is a cylindrical product; to an impact extrusion molding method; and to an impact extrusion molding apparatus, for molding the product.

BACKGROUND ART

A conventional impact extrusion molding method will be described with reference to FIGS. 15 and 16(*a*) to 16(*c*). It should be noted that the same constituent elements are denoted by the same reference numerals throughout the drawings. FIG. 15 is a partially sectional explanatory view of a conventional impact extrusion molding apparatus. FIG. 16(*a*) is a front view of a slug, which is a material; FIG. 16(*b*) is a cross-sectional view of a semifinished product (intermediate molded article); and FIG. 16(*c*) is a perspective view of a molded article (product).

In FIG. 15, a dice 1 is attached to a dice holder 10, and a punch 2 is attached to a punch holder 20. The dice 1 and the punch 2 are provided at a slide and a bolster of a press (not shown), respectively.

In the conventional impact extrusion molding method, a slug 30, made of such as aluminum alloy or the like, as shown in FIG. 16(*a*), is set in the dice 1, and the punch 2 is caused to slide, forcibly, from above the slug 30, into the dice 1, by a predetermined distance, whereby a bottomed cylindrical product 3, as shown in FIGS. 15 and 16(*c*), is molded through a semifinished product (intermediate molded article) 31, as shown in FIG. 16(*b*).

The product 3 thus molded is discharged from the dice 1 by a rod 4, for example, which goes through the bottom of the dice 1, and the dice holder 10. When the product 3 is raised together with the punch 2 while being attached to the punch 2, the product 3 is stripped away by a stripper plate or the like, not shown. The rod 4 is fixed so as to contact the slug 30 during molding operation. After finishing the molding operation, the rod 4 is forced into the dice 1, making it possible to discharge the product 3 from the dice 1.

In the molding process stated above, when the punch 2 is forced into the dice 1 by a certain depth or more, metal flows from the center to the side directions, as indicated by arrows r shown in FIG. 16(*b*), on the bottom of the semifinished product 31, which is being molded as shown in FIG. 16(*b*), and the metal thus flowing to the bottom side surfaces of the semifinished product is caused to flow, as indicated by arrows r', upward along the side surfaces of the semifinished product 31, toward the extrusion direction (opposite to the punch pressing direction) (which will be referred to as "metal-flow" in this specification).

The slug 30 may be a slug produced by cutting an extrusion molded rod material into slices, or a slug produced by blanking or cutting out a rolled plate material. Therefore, the metallographic structure of the outer surface portion of the slug 30, shown in FIG. 16(*a*), often differs in conditions from that of the bottom portion of the slug 30. If so, on the lower outer surfaces of the side of the molded product 3, metallographic structures having different conditions exist in a mixed state. As a result, as shown in FIG. 16(*c*), because of different working histories, a side surface region 3*a*, which differs in conditions, including surface glossiness and metallographic structure, from the other regions of the side surfaces, is formed.

Since such a region 3*a*, having different conditions, is concealed after the product 3 is subjected to a surface treatment, to coat the surface of the product 3 by coating or the like, it does not hamper the appearance of the product 3. However, when the surface treatment for coating the surface of the product 3 is not carried out, or when an anodizing, in particular, is conducted on the product 3, the region 3a having different conditions remains, with the result that the appearance of the product 3 is disadvantageously hampered.

SUMMARY OF THE INVENTION

The present invention is an impact extrusion molded article that is molded while suppressing the metal-flow from the bottom of a slug set in a dice toward the side of the molded product article. "To suppress the metal-flow" herein means to decrease the change quantity in metallographic structure on the lower outer surface on the side of the molded product article.

Further, the present invention is an impact extrusion molded article, wherein, the thickness of the side is t1, the thickness of the bottom is t2, the mean grain size in the impact extrusion direction is a, and the mean grain size in the direction perpendicular to the impact extrusion direction is b, and a/b in a range of [thickness of ¼(t1) from the outer surface of the side]×[height of 4(t2) from the outer surface of the bottom] is 10 or less, with respect to the cross section in the impact extrusion direction of the molded article.

Further, the present invention is an impact extrusion molding method for extruding a protrusion to be formed on the bottom of a semifinished product, which is being molded halfway along molding process, in an equal direction to the progress direction of a punch, when a cylindrical product is impact extrusion molded using the punch and a dice.

Further, the present invention is an impact extrusion molding apparatus comprising a punch; a dice, having a hole going through the bottom of the dice; and an opening and closing means, for opening and closing the hole by raising and lowering the said hole, wherein the said opening and closing means is controlled for back pressure in the direction opposite to the said punch that is applied to the opening and closing means, to close the said hole, when, at least, a slug set in the said dice starts to be pressurized by the punch, and so that the said back pressure is relieved from the opening and closing means, when a pressing force of the said punch reaches a predetermined value or more,.or/and the punch is lowered to a predetermined position.

Other and further features and advantages of the invention will appear more fully from the following description, taken in connection with the accompanying drawings.

BRIEF DESCRIPTION OF DRAWINGS

The patent or application file contains at least one drawing executed in color. Copies of this patent or patent application publication with color drawing(s) will be provided by the Office upon request and payment of the necessary fee.

FIG. 16(*b*) is a cross-sectional view of a semifinished product (intermediate molded article); and FIG. 16(*c*) is a perspective view of a molded article (product).

DISCLOSURE OF THE INVENTION

Figure 1:
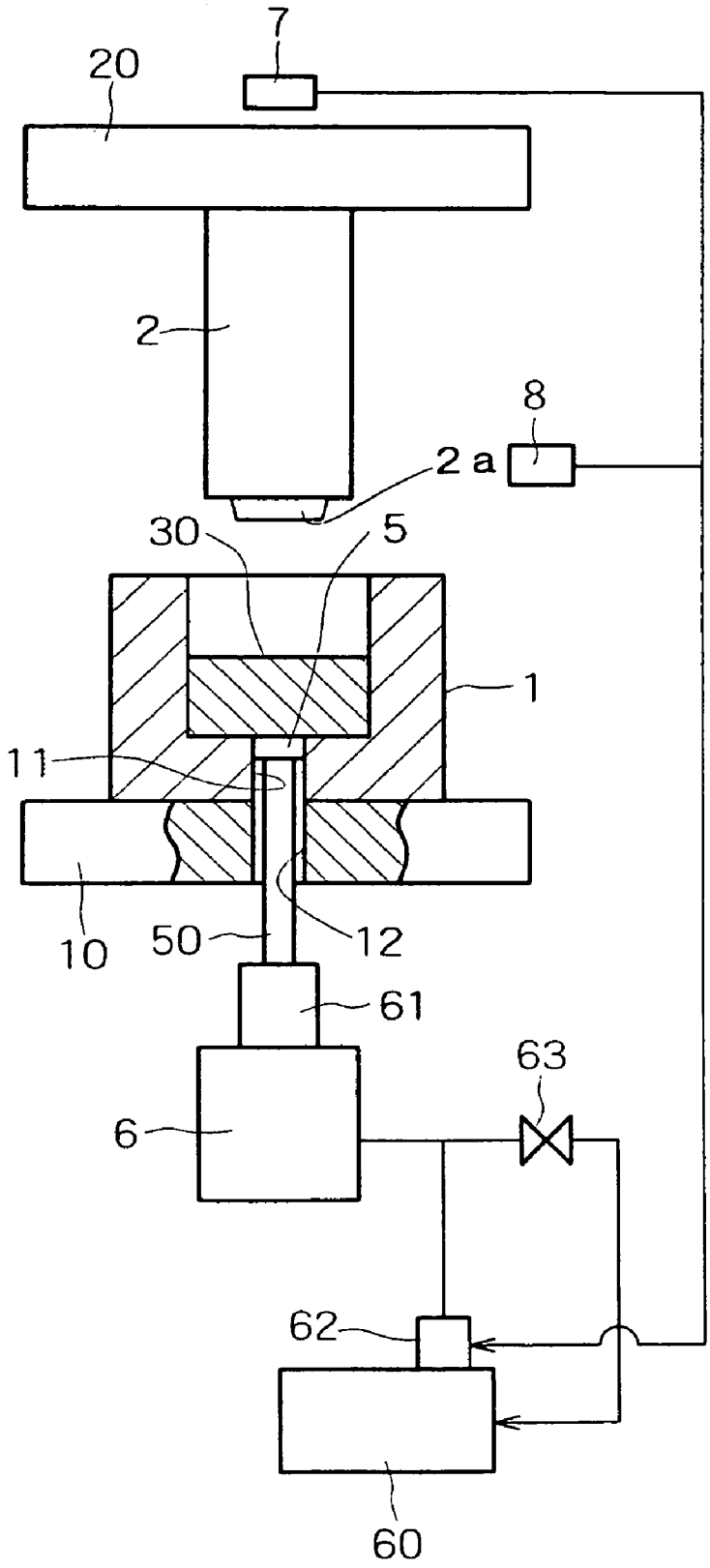
FIG. 1 is a partially sectional explanatory view showing the first embodiment of an impact extrusion molding apparatus according to the present invention.

According to the present invention, the following means are provided:

(1) An impact extrusion molded article characterized by being molded while suppressing the metal-flow from the bottom of a slug set in a dice toward the side of the molded product article.

(2) The impact extrusion molded article according to (1), wherein the impact extrusion molded article is molded using a punch, having a convex portion for forming an annular groove in the inner surface of the bottom of the product article, provided on the top end of the punch.

(3) An impact extrusion molded article, wherein, the thickness of the side is t1, the thickness of the bottom is t2, the mean grain size in the impact extrusion direction is a, and the mean grain size in the direction perpendicular to the impact extrusion direction is b; and a/b in a range of [thickness of ¼(t1) from the outer surface of the side]×[height of 4(t2) from the outer surface of the bottom] is 10 or less, with respect to the cross section in the impact extrusion direction of the molded article.

(4) An impact extrusion molding method characterized by extruding a protrusion to be formed on the bottom of a semifinished product, which is being molded halfway along the molding process, in an equal direction to the progress direction of a punch when a cylindrical product is impact extrusion molded using the punch and a dice.

(5) The impact extrusion molding method according to (4), wherein a convex portion, for forming an annular groove in the inner surface of the bottom of the molded product article, is provided on the top end of the punch.

(6) The impact extrusion molding method according to (4) or (5), wherein a hole going through the bottom of the dice is opened, when a pressing force of the said punch reaches a predetermined value or more, or/and the said punch is lowered to a predetermined position by pressurizing, by the punch, a slug set in the said dice while closing the hole.

(7) The impact extrusion molding method according to any one of (5) and (6), wherein, when a protrusion extruded into the hole in the bottom of the said dice is cut around a portion of the annular groove formed in the inner surface of the bottom of the molded product article, a cut region is discharged from within the dice.

(8) An impact extrusion molding apparatus comprising a punch; a dice, having a hole going through the bottom of the dice; and an opening and closing means, for opening and closing the hole by raising and lowering the said hole, wherein the said opening and closing means is controlled for back pressure in the direction opposite to the said punch that is applied to the opening and closing means, to close the said hole, when, at least, a slug set in the said dice starts to be pressurized by the punch, and so that the said back pressure is relieved from the opening and closing means, when a pressing force of the said punch reaches a predetermined value or more, or/and the punch is lowered to a predetermined position.

(9) The impact extrusion molding apparatus according to (8), wherein a convex portion, for forming an annular groove in the inner surface of the bottom of the molded product article, is provided on the top end of the said punch.

(10) The impact extrusion molding apparatus according to (8) or (9), wherein the said opening and closing means is attached to the top end of a rod raised and lowered in the hole in the bottom of the said dice, and the back pressure is applied and relieved on and from the opening and closing means through the said rod.

(11) The impact extrusion molding apparatus according to any one of (8) to (10), characterized by comprising a mechanism to discharge a cut region from within the dice, when a protrusion extruded into the hole in the bottom of the said dice is cut around a portion of the annular groove provided in the inner surface of the bottom of the molded product article.

In the present invention, the range of [thickness of ¼(t1) from the outer surface of the side]×[height of 4(t2) from the outer surface of the bottom] means the range of a sectional area having a thickness (which is a thickness ¼ times as large as the thickness of the side of a molded article, measured from the outer surface of the side of the molded article) and a height (which is a height 4 times as large as the thickness of the bottom of the molded article, measured from the outer surface of the bottom of the molded article).

BEST MODE FOR CARRYING OUT THE INVENTION

After devoted study and due consideration, the inventors of the present invention concluded that impact extrusion molding can be conducted with metal flow from the bottom of a slug toward the side of the molded product being suppressed, by opening and closing a hole in the bottom of a dice, and that an impact extrusion molded article that is small in the variation of metallographic structure on the lower outer surfaces on the side of the molded product, and that is excellent in appearance design, can be thereby obtained.

The present invention has been completed based on this knowledge.

The preferred embodiments of the impact extrusion molded article, the impact extrusion molding method, and the impact extrusion molding apparatus according to the present invention, will be described hereinafter with reference to FIGS. 1 to 9. It should be noted that the same constituent elements are denoted by the same reference numerals throughout the drawings in explanation of the respective drawings.

FIRST EMBODIMENT

Figure 2:
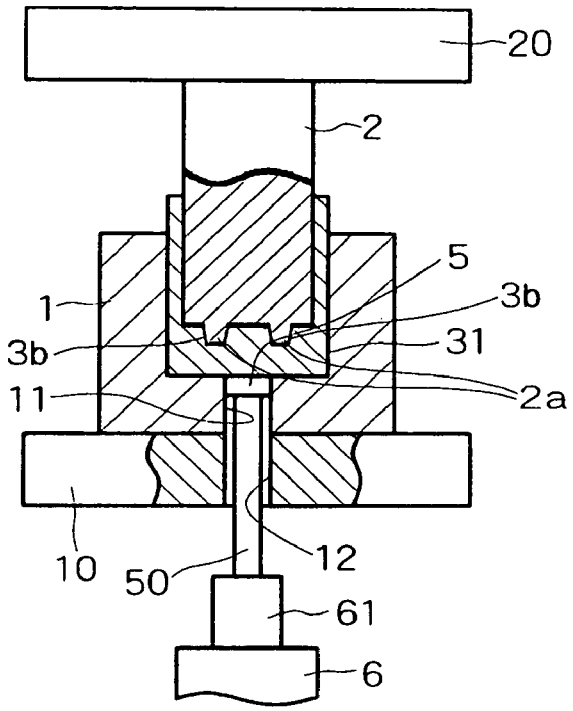
FIG. 2 is a partially sectional explanatory view showing that a semifinished product is extrusion molded by the apparatus in the first embodiment shown in FIG. 1.
Figure 3:
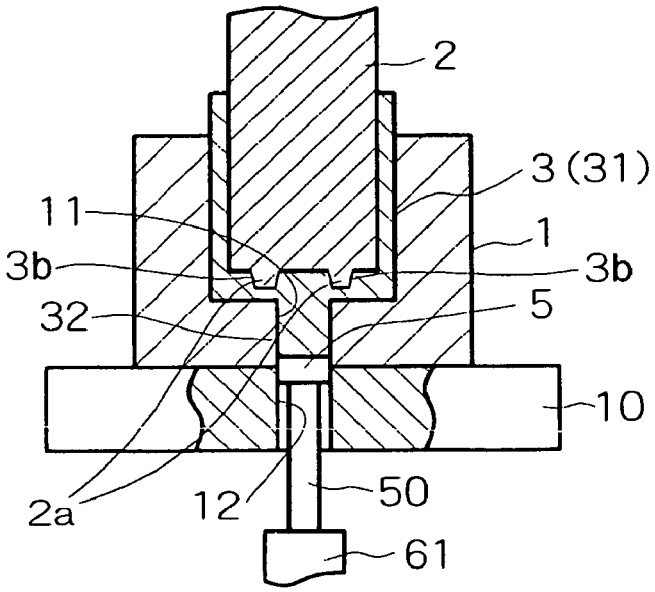
FIG. 3 is a partially sectional explanatory view showing a state in which the molding of the semifinished product shown in FIG. 2 is further progressed.
Figure 4:
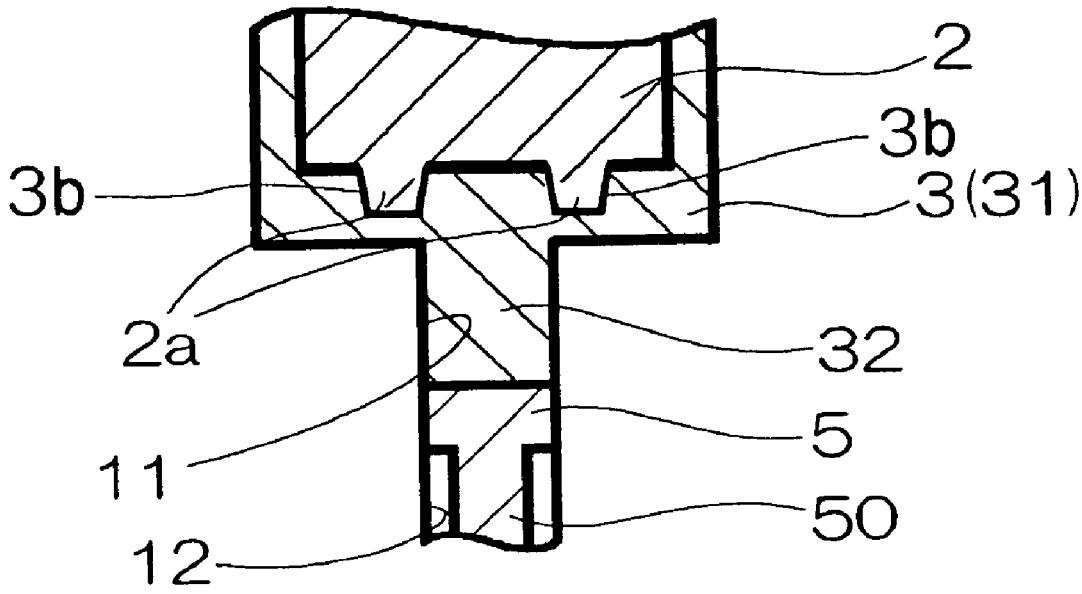
FIG. 4 is an enlarged sectional explanatory view showing the top end portion of a punch shown in FIG. 3.
Figure 5:
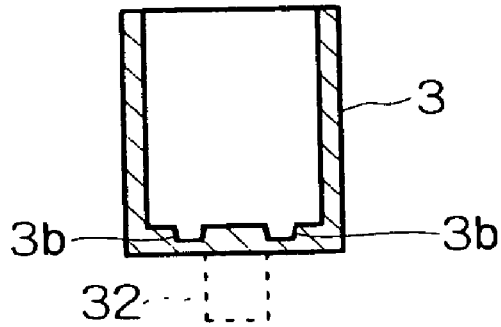
FIG. 5 is a cross-sectional view of an extrusion molded product.

FIG. 1 is a partially sectional explanatory view showing the first embodiment of the impact extrusion molding apparatus according to the present invention. FIGS. 2 and 3 are partially sectional explanatory views showing that a semifinished product is being extrusion molded by the apparatus in the first embodiment shown in FIG. 1. FIG. 4 is an enlarged sectional explanatory view of the top end portion of a punch shown in FIG. 3. FIG. 5 is a cross-sectional view of an extrusion molded product.

In FIG. 1, a dice 1 and a punch 2 are attached to a dice holder 10 and a punch holder 20, respectively, similarly to the conventional apparatus.

Holes 11 and 12, equal in diameter and communicating with each other, are formed to go through the bottom of the dice 1, and that of the dice holder 10, respectively. A rod 50 is provided, to slide in these holes 11 and 12, and an opening/closing means 5, for opening and closing the hole 11 in the bottom of the dice 1, is provided on the upper end of the rod 50.

A back pressure applying means 6, which consists of, for example, a hydraulic cylinder, is provided below the dice holder 10. The back pressure applying means 6 is constituted to be supplied with pressure from a hydraulic pump 60, at appropriate times.

The opening/closing means 5 operates as follows. When back pressure in a direction opposite to the punch 2 is applied to the opening/closing means 5, by the back pressure applying means 6, through a piston 61 and the rod 50, the opening/closing means 5 closes the hole 11 in the bottom of the dice 1 against the molding pressure of the punch 2. By relieving the back pressure applied by the back pressure applying means 6 on the opening/closing means 5, the opening/closing means 5 is lowered, to open the hole 11 in the bottom of the dice 1.

A pressure sensor 7, which detects molding load (pressure) applied by the punch 2, is provided above the punch 2, and a position sensor 8, which detects the level of the punch 2, is provided on the side of the punch 2. Based on detection information from these sensors 7 and 8, the solenoid valve 62 of the hydraulic pump 60 is opened or closed, thus controlling the back pressure applying means 6.

A relief valve 63 functions to prevent excessive pressure from being generated in the hydraulic cylinder.

The function of the molding apparatus in the first embodiment will be described, while also describing the molding method in detail.

First, as shown in FIG. 1, a slug 30 is set in the dice 1, and the solenoid valve 62 of the back pressure applying means 6 is opened, to apply back pressure on the opening/closing means 5, and to close the hole 11 in the bottom of the dice 1. In this state, the punch 2 is lowered, to start molding operation.

As shown in FIG. 2, the molding operation progresses. When the pressing force of the punch 2, which is monitored by the pressure sensor 7, reaches a predetermined value, or the position of the punch 2, which is detected by the position sensor 8, reaches a predetermined position, then the solenoid valve 62 is closed, to relieve the back pressure applied to the opening/closing means 5.

When the back pressure applied to the opening/closing means 5 is relieved, the opening/closing means 5 is lowered, by a predetermined distance, to open the upper end portion of the hole 11 in the bottom of the dice 1, as shown in FIG. 3. Following this, a protrusion 32 is extruded toward the bottom of the semifinished product 31, in the same direction as the progress direction of the punch 2 along the hole 11. When the protrusion 32 starts to be extruded, the semifinished product 31 becomes deeper than that in the state shown in FIG. 2, but the extension of the semifinished product 31 toward the upward of the sidewalls thereof is stopped.

The punch 2 is continuously lowered without intermission from the start to the end of the molding operation, whereby the molding operation is carried out in one step.

In the state shown in FIG. 3, the molding operation is stopped, the punch 2 is raised, back pressure is applied to the opening/closing means 5, to thereby raise the means 5; the semifinished product 31 is discharged from the dice 1, and the protrusion 32 of the semifinished product 31 is cut off, thereby providing a bottomed cylindrical product 3, as shown in FIG. 5. When the bottom of the semifinished product 31 is cut off together with the protrusion 32, a cylindrical product without a bottom is provided.

A convex portion 2*a*, for forming an annular groove 3*b* on the inner surface of the bottom of the molded product article, may be provided on the top end of the punch 2.

On the side of the protrusion 32 thus extruded, lubricant coated on the slug cannot follow up the extrusion of the material, because of the pressurization of the punch 2, thus generating a new surface. The frictional resistance between the newly generated surface and the side of the dice hole 11 gradually grows. When this frictional resistance becomes too high, the semifinished product 31 cannot be satisfactorily discharged from the dice 1 when pushing up the rod 50 after completion of the molding operation, and a tensile force acts between the main body of the product 3 and the protrusion 32 thereof. As a result, the main body of the product 3 may possibly be deformed.

By providing the convex portion 2*a*, for forming the annular groove 3*b* on the inner surface of the bottom of the product 3, on the top end portion of the punch 2, the portion put between this convex portion 2*a* and the dice 1 becomes thinner, making it possible to form the annular groove 3*b* on the inner surface of the bottom of the molded article. The formation of this groove 3*b* enables the thin bottom wall of the groove 3*b* to be cut, so as to cut away the protrusion 32 before the product main body is deformed, even if tensile force is generated at the time of discharging the semifinished product. Therefore, it is possible to prevent deformation of the product main body. The shape of the convex portion 2*a*, for forming the groove 3*b* on the inner surface of the bottom of the molded product article, is not limited to a specific one. However, preferably the convex portion 2*a* is arranged continuously to a position adjacent the dice bottom hole 11 (which position corresponds to the outer periphery of the hole 11), and it has a generally trapezoidal cross section. In addition, the groove formed by this convex portion preferably has a depth of 50 to 80% (more preferably 60 to 70%) of the thickness of the bottom of the finally obtained product.

For example, when a product having an annular groove of a depth of 50% formed in a predetermined bottom thickness (t2) is to be manufactured, then the convex portion with a height of half the predetermined bottom thickness (t2) is formed on the top end of the punch, and the punch is stopped at a position with the predetermined bottom thickness (t2). The desired product can be thus manufactured.

When the protrusion 32 is cut off from the semifinished product 31 in the portion of the groove 3*b* formed by the convex portion 2*a* which is provided at the punch 2, then the molding operation is stopped; the punch 2 is raised, to pull off the punch 2 and the semifinished product 31 from the dice 1, and back pressure is then applied to the opening/closing means 5, to thereby raise the opening/closing means 5. The protrusion 32 can be thus extruded into the dice 1 from the dice hole 11, and the protrusion 32 can then be eliminated from within the dice 1, by air blowing, chucking, or the like.

Figures 16A, 16B, 16C:
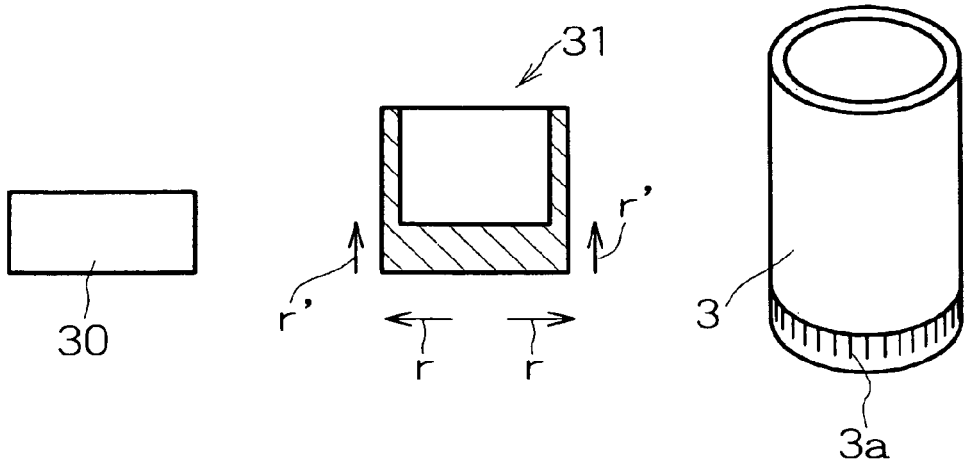
FIG. 16(*a*) is a front view of a slug, which is a material.

According to the present invention, as described above, the protrusion 32 is extruded into the dice hole 11 from the bottom of the semifinished product 31 in the middle of the molding operation, thereby preventing or suppressing the metal-flow in the peripheral direction to the lower outer surfaces on the side of the semifinished product 31. Therefore, the region 3a, shown in FIG. 16(*c*), is not formed on the lower outer surfaces of the side of the product 3.

Hence, the appearance of the product 3 is not hampered, improving the surface quality of the product 3 after, for example, an anodizing.

SECOND EMBODIMENT

Figure 6:
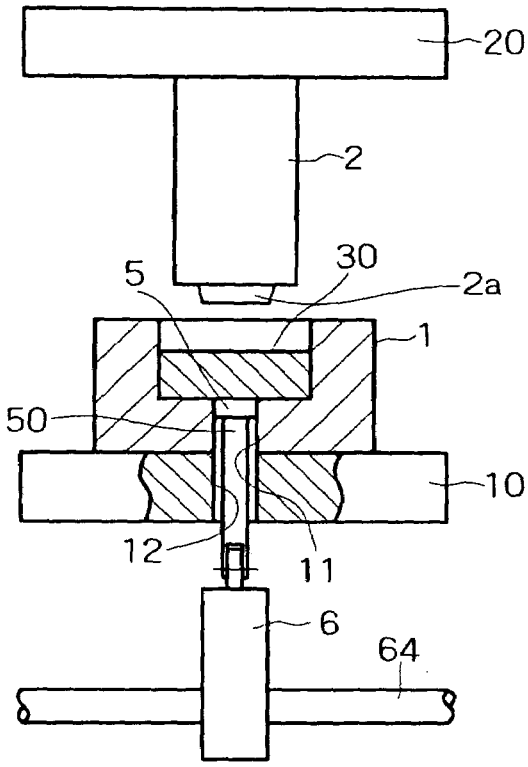
FIG. 6 is a partially sectional explanatory view showing the second embodiment of the molding apparatus according to the present invention.

FIG. 6 is a partially sectional explanatory view showing the second embodiment of the molding apparatus according to the present invention. The back pressure applying means 6 consists of a cam, having a cam shaft 64. The other constituent elements of the molding apparatus in the second embodiment, and the function and advantages thereof, are almost the same as those of the molding apparatus in the first embodiment, which will not be described herein.

THIRD EMBODIMENT

Figure 7:
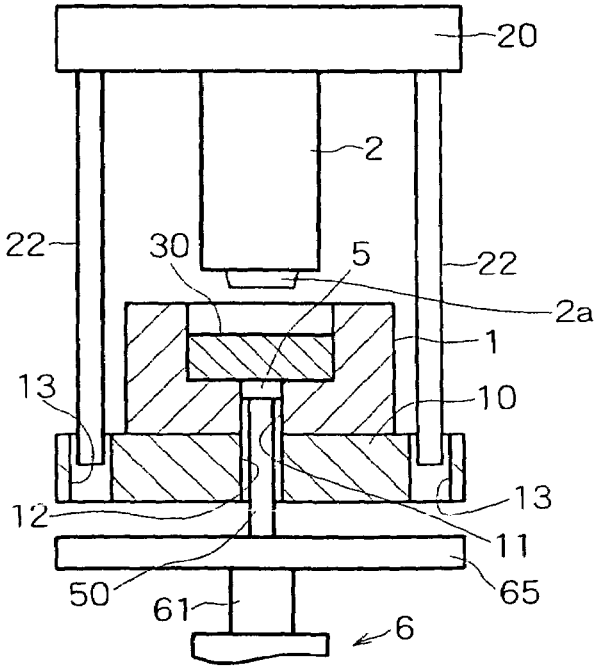
FIG. 7 is a partially sectional explanatory view showing the third embodiment of the molding apparatus according to the present invention.

FIG. 7 is a partially sectional explanatory view showing the third embodiment of the molding apparatus according to the present invention.

In the third embodiment, an appropriate number of cushion pins 22 are attached to the lower portion of the outer periphery of the punch holder 20. The cushion pins 22 are constituted as follows. The respective cushion pins 22 are lowered when the punch 2 is lowered; the lower end portions of the cushion pins 22 are protruded downward from guide holes 13, formed in the dice holder 10, respectively; the cushion pad 65 of the back pressure applying means 6 is pushed down, to thereby relieve the back pressure applied to the opening/closing means 5. In this embodiment, it is possible to dispense with the pressure sensor 7 and the position sensor 8, shown in FIG. 1.

The other constituent elements of the molding apparatus in this embodiment, and the function and advantages thereof, are almost the same as those of the molding apparatus in the first embodiment, which will not be described herein.

FOURTH EMBODIMENT

Figure 8:
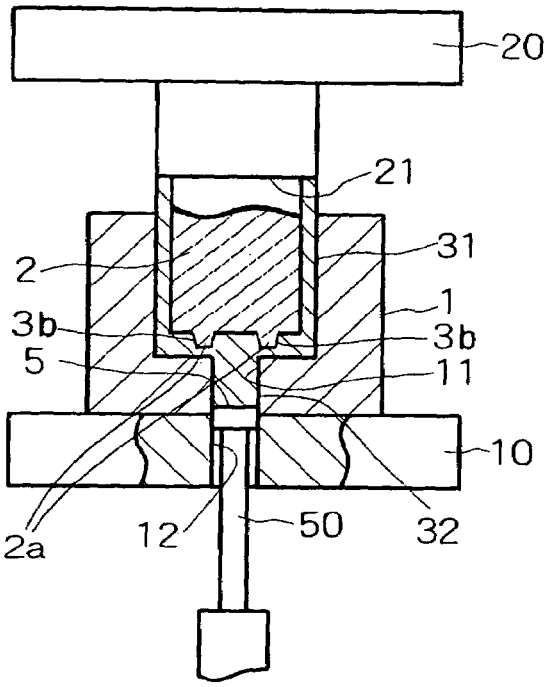
FIG. 8 is a partially sectional explanatory view showing the fourth embodiment of the molding apparatus according to the present invention.

FIG. 8 is a partially sectional explanatory view showing the fourth embodiment of the molding apparatus according to the present invention.

In the fourth embodiment, a downward stepped portion 21, against which the peripheral wall of the semifinished product 31 is abutted, is formed on the outer peripheral portion of the punch 2. When the protrusion 32 is extruded toward the bottom of the semifinished product 31, it prevents extension of the semifinished product 31 in the upward direction of the sidewall.

The other constituent elements of the molding apparatus in this embodiment, and the function and advantages thereof, are almost the same as those of the molding apparatus in the first embodiment, which will not be described herein.

ANOTHER EMBODIMENT

Figure 9:
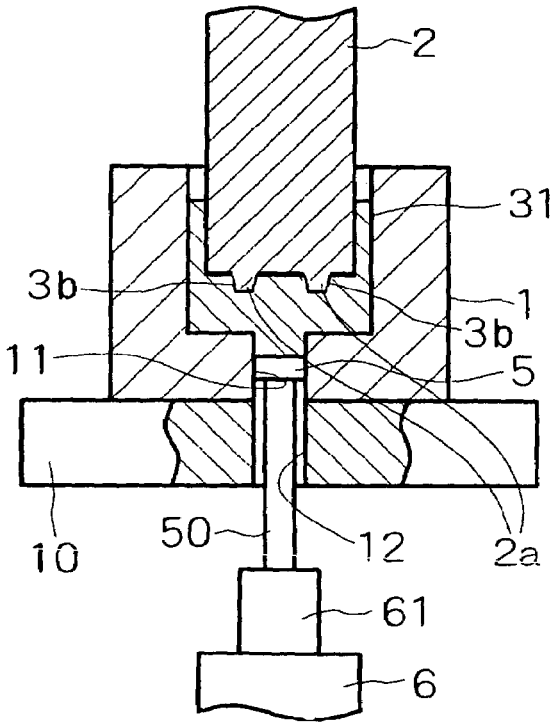
FIG. 9 is a partially sectional explanatory view showing another embodiment of the molding apparatus according to the present invention.

When a cylindrical product is to be impact extrusion molded, molding operation is often started as shown in, for example, FIG. 9, after the punch 2 is lowered while the opening/closing means 5 is slightly lowered or raised, as compared with the position shown in FIG. 2. In this case, as in the case of the above, when the punch 2 is forced into the dice 1 by a certain depth or more, the metal-flow in a side direction is generated on the bottom of the semifinished product 31. Considering this, when the molding load of the punch 2 reaches a predetermined value or more, or the punch 2 becomes a predetermined level or less, the back pressure applied to the opening/closing means 5, is relieved, to lower the opening/closing means 5.

In the molding apparatus in this embodiment, as a mechanism for applying and relieving back pressure on and from the opening/closing means 5, any mechanisms that can close the upper end portion of the hole 11 in the bottom of the dice 1, against the molding pressure of the punch, by the opening/closing means 5, and that can lower the opening/closing means 5 at appropriate times, can be used, and this mechanism is not limited to those described in the preceding embodiments.

The impact extrusion molded article according to the present invention obtained in each of the above-stated embodiments preferably satisfies that a/b in the range of [thickness of ¼(t1) from the outer surface of the side]× [height of 4(t2) from the outer surface of the bottom] is 10 or less, more preferably 2 to 8, where t1 is the thickness of the side, t2 is the thickness of the bottom, a is the mean grain size in the impact extrusion direction, and b is the mean grain size in the direction perpendicular to the impact extrusion direction, with respect to the cross section in the impact extrusion direction of the molded article.

The impact extrusion molded article according to the present invention can be formed into a product excellent in appearance design, by suppressing the metal-flow from the bottom of the slug toward the side of the molded product article.

According to the impact extrusion molding method of the present invention, the bottom material of the semifinished product is extruded in the middle of molding operation, and the metal-flow from the bottom of the semifinished product toward the side of the molded product article is suppressed, thereby improving the surface quality of the molded product.

The impact extrusion molding apparatus according to the present invention can smoothly and surely carry out the molding method.

The present invention will be described in more detail based on examples given below, but the present invention is not meant to be limited by these examples.

EXAMPLE

A metal mold for manufacturing a product having an outline of an upper opening end of the molded product, which is formed into a generally elliptic shape, having a longer diameter of 40 mm and a shorter diameter of 15 mm, having a height of 90 mm, a thickness of a side of 0.6 mm, and a thickness of a bottom of 1.2 mm, is manufactured. Using this metal mold, an experiment is carried out.

For the shape of a slug, a 6063-O extrusion material, having a cross section formed so that a profile is offset from the outline of the upper opening end of the molded product inward by 0.5 mm, is prepared. The 6063-O extrusion material is cut into a length to obtain a predetermined product height, and then a lubricating coat is formed by a bonding treatment. For reference, the cut length of the slug according to the present invention is 16 mm, whereas that according to a comparison (i.e. the conventional method) is 9 mm.

The apparatus used for impact extrusion is a mechanical press of 250 tons, and a metal mold is attached to this press.

The hole in the bottom of the dice is opened and closed by hydraulic pressure. That is, a crank angle signal is fetched from the press, and the signal is connected to the hydraulic pump, so that the pressure of the press can be changed in two steps. Pressure from this hydraulic pump is connected to the hydraulic cylinder attached to the lower portion of the dice. At a predetermined crank angle, the pressure applied to the opening/closing means can be relieved. For reference, according to the present invention, the dice bottom hole is designed to be open when the bottom thickness of the semifinished product becomes 7 mm. According to the comparison, one step is executed while the dice bottom hole is kept open.

Figure 10:
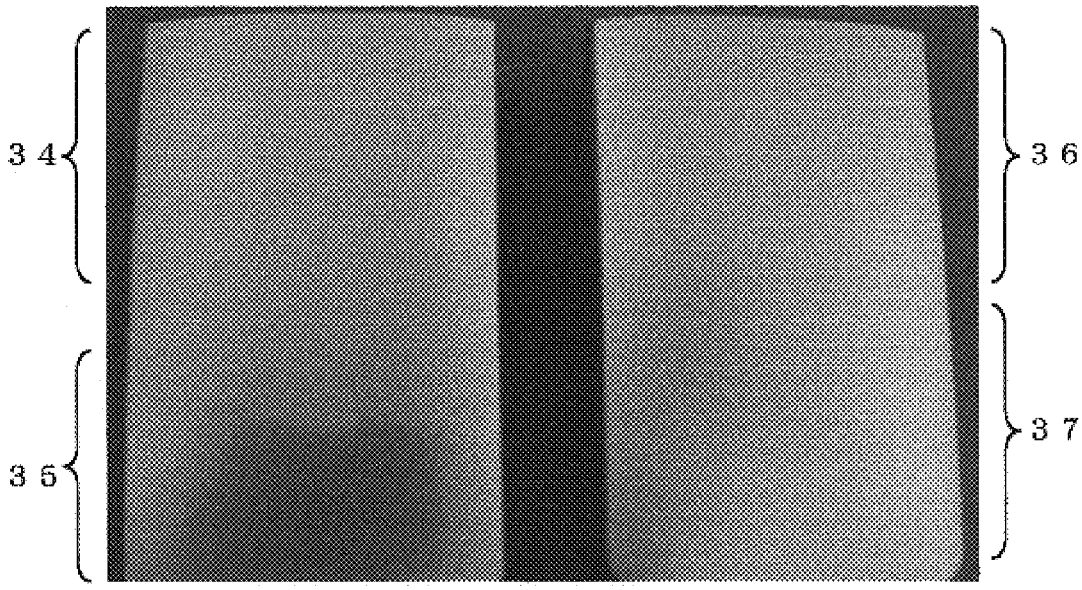
FIG. 10(*a*) shows a photograph of the side of a comparison after an anodizing, and FIG. 10(*b*) shows a photograph of the side of an example of the present invention after an anodizing.

The example and comparison thus manufactured are subjected to anodizing, respectively, and compared with each other by visual inspection. FIG. 10(*a*) shows a photograph of the side of the comparison, and FIG. 10(*b*) shows a photograph of the side of the example of the present invention. As is obvious from FIGS. 10(*a*) and 10(*b*), a region different in surface glossiness from the upper outer surface 34 of the side of the molded product article, is formed on the lower outer surface 35 of the side thereof according to the comparison, while the surface glossiness of the lower outer surface 37 of the side of the molded product appears substantially identical to that of the upper outer surface 36 of the side thereof according to the example of the present invention.

Next, the cross sections of the sidewalls in the vicinity of the corners between the sides and the bottoms of the example and comparison are observed, using an inverted optical microscope, manufactured by Olympus Optical Co., Ltd. (magnification ×50).

Figure 11:
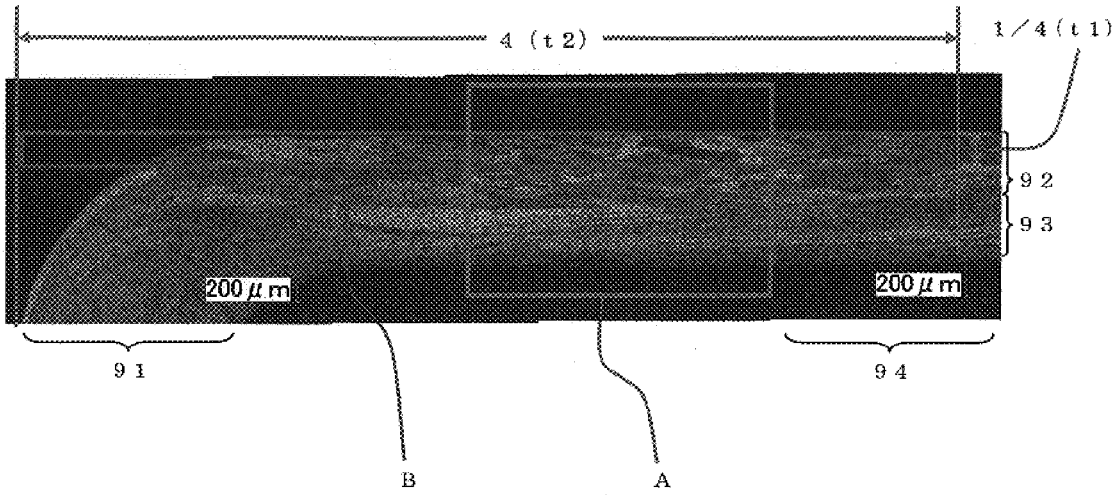
FIG. 11 shows a microscopic photograph of a metallographic structure obtained by photographing the sidewall cross section of the impact extrusion molded article according to the present invention, using an optical microscope.
Figure 12:
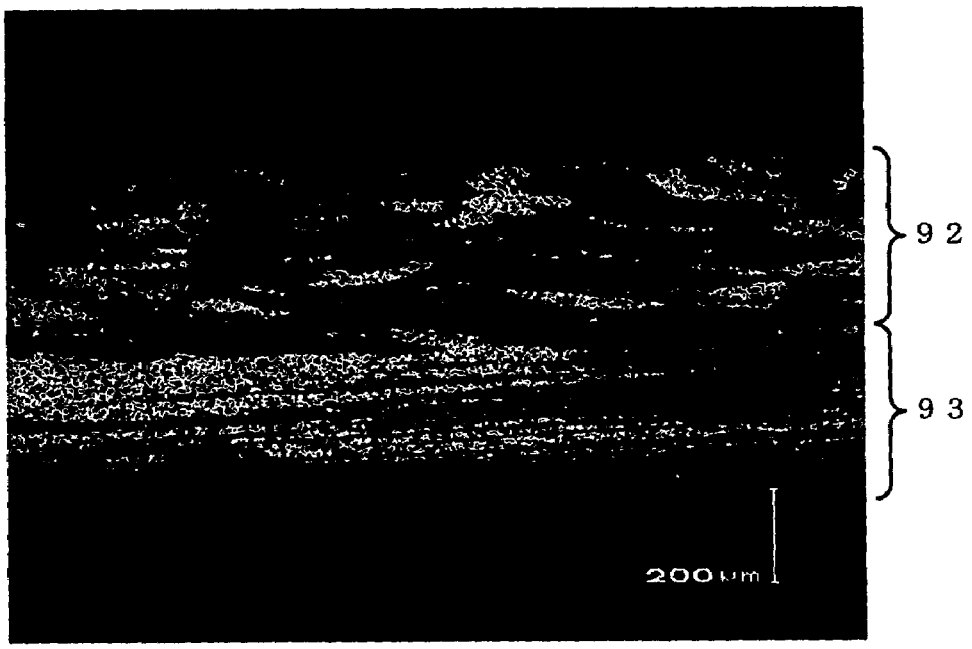
FIG. 12 shows a microscopic photograph of a metallographic structure obtained by photographing a sidewall cross section in the vicinity of the corner between the side and bottom of the impact extrusion molded article according to the present invention, using an optical microscope.
Figure 13:
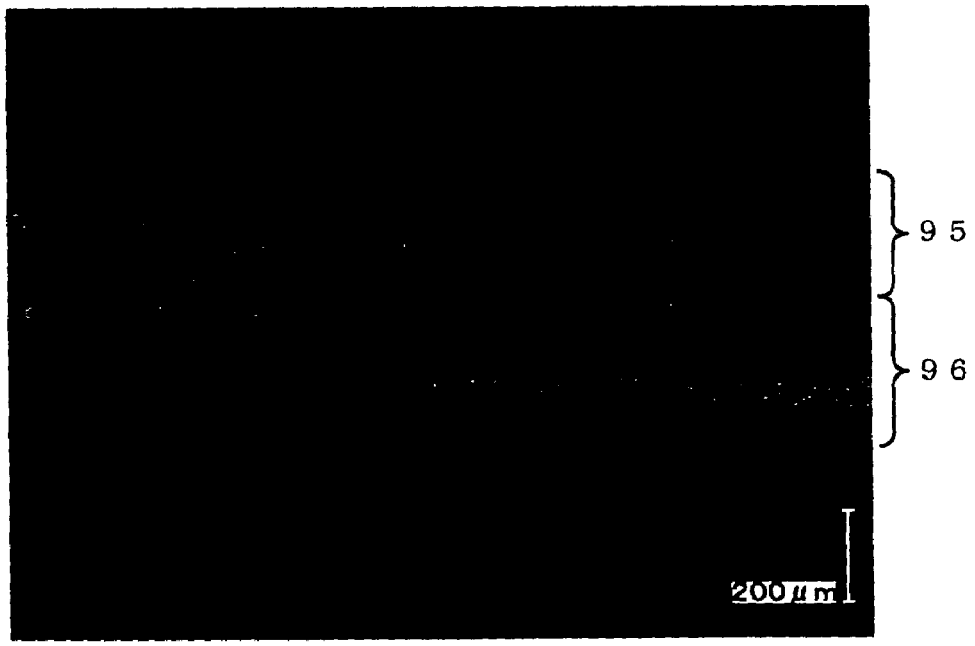
FIG. 13 shows a microscopic photograph of a metallographic structure obtained by photographing a sidewall cross section in the vicinity of the corner between the side and bottom of the impact extrusion molded article, as a comparison that is manufactured by conventional impact extrusion molding, using an optical microscope.

FIG. 11 shows a photograph taken by the optical microscope, showing the metallographic structure of the cross section of the sidewall of the impact extrusion molded article according to the present invention. In FIG. 11, reference numeral 91 denotes the bottom of the molded product article; reference numeral 92 denotes the outer side portion of the molded product article; reference numeral 93 denotes the inner side portion of the molded product article, and reference numeral 94 denotes the upper portion of the molded product article. FIG. 12 shows a photograph in which the range of a frame A shown in FIG. 11 is enlarged. FIG. 13 shows a photograph showing the cross section of the portion corresponding to FIG. 12 in the comparison. In FIG. 12, reference numeral 92 denotes the outer side portion of the molded product article, and reference numeral 93 denotes the inner side portion of the molded product article. In FIG. 13, reference numeral 95 denotes the outer side portion of the molded product article, and reference numeral 96 denotes the inner side portion of the molded product article.

As is obvious from FIG. 13, in the conventional molded article as the comparison, the cross sections (95 and 96) of the side of the molded product article have fiber structures as a whole, and it is found that the metal-flow from the bottom of the slug is conspicuous. "Fiber structure" here means a structure in which the mean grain size a, in the impact extrusion direction, is much larger than the mean grain size b, in the direction perpendicular to the impact extrusion direction.

According to the example of the present invention, by contrast, the cross section of the inner side 93 of the molded product article has a fiber structure, while that of the outer side 92 thereof is small in the deformation quantity of crystal structures and has no fiber structure, as is obvious from FIG. 12. From this, it is found that the metal-flow from the bottom of the slug is suppressed in the example of the present invention.

Furthermore, as for the range of [thickness of ¼(t1) from the outer surface of the side]×[height of 4(t2) from the outer surface of the bottom] in the photograph showing the cross section, structure observation is conducted by the Baker method, to measure mean grain size. This measurement method will be described with reference to FIG. 14.

Figure 14:
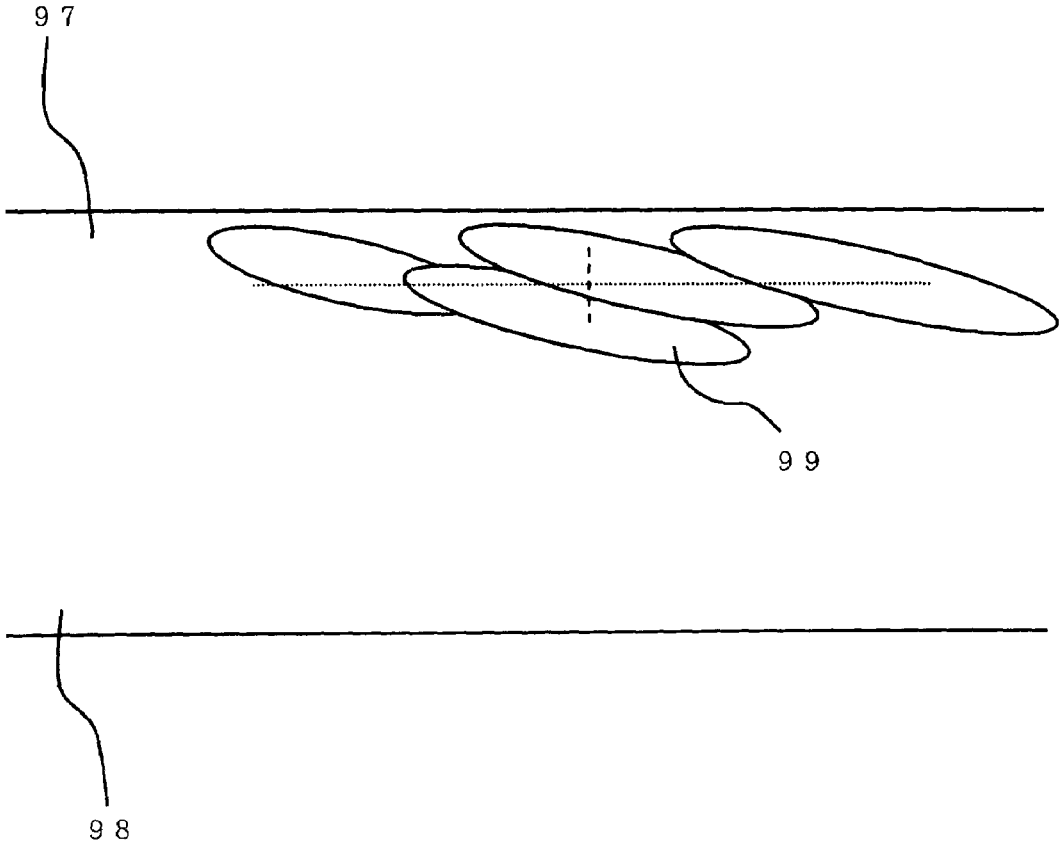
FIG. 14 is a typical view showing a method for measuring a mean grain size in a cross section in an impact extrusion direction.
Figure 15:
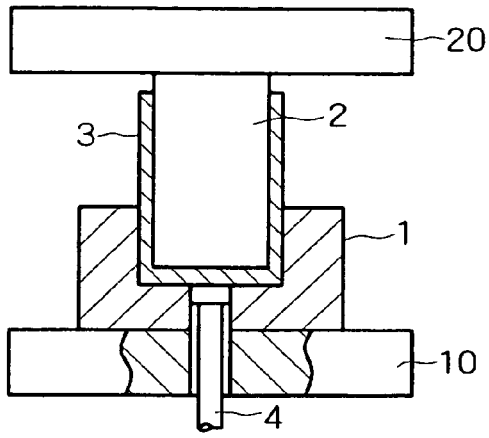
FIG. 15 is a partially sectional explanatory view showing a conventional impact extrusion molding apparatus.

FIG. 14 is a typical view showing the method for measuring a mean grain size in the cross section in the extrusion direction. In FIG. 14, reference numeral 97 denotes the outer side portion of the molded product article; reference numeral 98 denotes the inner side portion of the molded product article, and reference numeral 99 denotes a crystal grain. First, in the measurement region indicated by a frame B in FIG. 11, an appropriate length of a straight line is drawn in parallel to directions in which the grain size is to be measured, as indicated by dotted lines in FIG. 14. Next, how many crystal grains 99 this straight line includes in the certain range is calculated, by measuring the straight line multiple times (normally 5 to 10 times), and the sum of the measured lengths of the straight lines is divided by the sum of the measured number of crystal grains, thus obtaining the mean grain size.

The above-stated operation is conducted on the example and the comparison for the two directions indicated by the dotted lines in FIG. 14, respectively, and mean grain sizes a and b, are obtained, and a/b is calculated for the example and the comparison, respectively. As a result, according to the example of the present invention, a/b in the range of [thickness of ¼(t1) from the outer surface of the side]×[height of 4(t2) from the outer surface of the bottom] is 3.8. According to the comparison, a/b in the range of [thickness of ¼(t1) from the outer surface of the side]×[height of 4(t2) from the outer surface of the bottom] is 125.

Therefore, according to the present invention, it is possible to suppress the metal-flow from the bottom of the slug, to decrease the variation of the metallographic structure on the lower outer surface of the side of the molded product article, and to thereby obtain a molded product article whose appearance is not hampered.

INDUSTRIAL APPLICABILITY

The impact extrusion molded article of the present invention can be applied to a cylindrical product, for example, a cover of small-sized equipment such as a portable game machine, a cellular phone and others. Further, according to the impact extrusion molded article of the present invention, a region different in conditions is not generated on the lower outer surface of the side of the molded product article, and the appearance of the product is not hampered even if a surface treatment is not conducted on the product, or if an anodizing is conducted to the surface of the product.

Further, it is possible to manufacture a molded article excellent in appearance design by the impact extrusion molding method according to the present invention.

Moreover, the impact extrusion molding apparatus according to the present invention can smoothly carry out the impact extrusion molding method described above.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. An impact extrusion molding method characterized by extruding a protrusion to be formed on the bottom of a semifinished product, which is being molded halfway alone molding process, in an equal direction to the progress direction of a punch when a cylindrical product is impact extrusion molded using a punch and a dice, and which protrusion is being molded while suppressing the metal-flow from the bottom of a slug set in the dice toward the side of the molded product article, wherein a convex portion, for forming an annular groove in the inner surface of the bottom of the molded product article, is provided on the top end of said punch, and wherein, when a protrusion extruded into the hole in the bottom of the said dice is cut around a portion of the annular groove formed in the inner surface of the bottom of the molded product article, a cut region is discharged from within the dice.

2. The impact extrusion molding method according to claim 1, wherein a hole going through the bottom of the dice is opened, when a pressing force of said punch reaches a predetermined value or more, and/or said punch is lowered to a predetermined position by pressurizing, by the punch, a slug set in said dice while closing the hole.

3. An impact extrusion molding apparatus comprising a punch;

a dice, having a hole going through the bottom of the dice;

an opening and closing means, for opening and closing the hole by raising and lowering said hole; and a rod on the upper end of which the opening and closing means is provided, wherein said opening and closing means is controlled for back pressure in the direction opposite to said punch that is applied to the opening and closing means, to close said hole, at least when a slug set in said dice starts to be pressurized by the punch, and so that said back pressure is relieved from the opening and closing means, when a pressing force of said punch reaches a predetermined value or more, and/or said punch is lowered to a predetermined position, and wherein the rod is adapted to slide a distance that gives minimum volume suppressing metal-flow from a bottom of slug set in a dice toward a side of a molded product article, and wherein a convex portion, for forming an annular groove in the inner surface of the bottom of the molded product article, is provided on the top end of said punch, and said impact extrusion molding apparatus comprising a mechanism to discharge a cut region from within the dice, when a protrusion extruded into the hole in the bottom of the said dice is cut around a portion of the annular groove provided in the inner surface of the bottom of the molded product article.

4. The impact extrusion molding apparatus according to claim 3, wherein said opening and closing means is attached to the top end of the rod raised and lowered in the hole in the bottom of said dice, and said back pressure is applied and relieved on and from the opening and closing means through said rod.

* * * * *

UNITED STATES PATENT AND TRADEMARK OFFICE

CERTIFICATE OF CORRECTION

PATENT NO. : 7,117,704 B2
APPLICATION NO. : 10/915459
DATED : October 10, 2006
INVENTOR(S) : Ken-ichi Ogura et al.

It is certified that error appears in the above-identified patent and that said Letters Patent is hereby corrected as shown below:

In the Claims;
On line 45 of column 11, change “alone” to be -- along --

Signed and Sealed this

Twentieth Day of November, 2007

JON W. DUDAS
*Director of the United States Patent and Trademark Office*